US005256937A

United States Patent [19]

Bubeck et al.

[11] Patent Number: 5,256,937

[45] Date of Patent: Oct. 26, 1993

[54] FLAT PANEL FLUORESCENT SCREEN DISPLAY TUBE

[75] Inventors: Gotthold Bubeck, Erkenbrechtsweiler; Stefan Speh, Ulm-Gögglingen; Kurt-Manfred Tischer, Wendlingen, all of Fed. Rep. of Germany

[73] Assignee: Nokia (Deutschland) GmbH, Pforzheim, Fed. Rep. of Germany

[21] Appl. No.: 827,902

[22] Filed: Jan. 30, 1992

Related U.S. Application Data

[63] Continuation of Ser. No. 503,479, Apr. 2, 1990, abandoned.

[30] Foreign Application Priority Data

Apr. 7, 1989 [DE] Fed. Rep. of Germany ..... 3911343

[51] Int. Cl.[5] ..... H01J 31/12

[52] U.S. Cl. ..... 313/495; 313/422; 313/497; 313/482

[58] Field of Search ..... 313/422, 495, 497, 482

[56] References Cited

U.S. PATENT DOCUMENTS

| | | | |
|---|---|---|---|
| 4,223,244 | 9/1980 | Kishino et al. | 313/497 |
| 4,325,489 | 4/1982 | Russell et al. | 313/422 X |
| 4,374,343 | 2/1983 | Chang | 313/422 |
| 4,720,657 | 1/1988 | Tischer | 313/422 X |
| 4,737,690 | 4/1988 | Lampert et al. | 313/422 X |
| 4,745,332 | 5/1988 | Tischer | 313/422 |
| 4,829,212 | 5/1989 | Serio et al. | 313/482 X |
| 4,855,640 | 8/1989 | Caple | 313/422 X |
| 4,884,005 | 11/1989 | Kornaker et al. | 313/404 |
| 4,965,487 | 10/1990 | Freeman | 313/422 |

FOREIGN PATENT DOCUMENTS

| | | |
|---|---|---|
| 0250821 | 1/1988 | European Pat. Off. . |
| 0311938 | 4/1989 | European Pat. Off. . |
| 2742555 | 3/1978 | Fed. Rep. of Germany . |
| 3222850 | 12/1983 | Fed. Rep. of Germany . |
| 3344060 | 6/1984 | Fed. Rep. of Germany . |
| 3319750 | 12/1984 | Fed. Rep. of Germany . |
| 3411975 | 10/1985 | Fed. Rep. of Germany . |
| 3435567 | 4/1986 | Fed. Rep. of Germany . |
| 3445628 | 6/1986 | Fed. Rep. of Germany . |
| 3445629 | 6/1986 | Fed. Rep. of Germany . |
| 3529041 | 2/1987 | Fed. Rep. of Germany . |
| 3530923 | 3/1987 | Fed. Rep. of Germany . |
| 3534030 | 3/1987 | Fed. Rep. of Germany . |
| 3622259 | 1/1988 | Fed. Rep. of Germany . |
| 3711391 | 10/1988 | Fed. Rep. of Germany . |
| 1391102 | 4/1975 | United Kingdom . |

OTHER PUBLICATIONS

DE-Z: Siebert, H.-P.: Anzeigentechologien im Uberblick, In: Elektronik, 19, Sep. 19, 1985, S. 115-120.

DE-Z: Funkschau, Mar. 1985, S. 32-35.

US-Z: Schauer, Alois: Plasma Lights up 14-in. flat panel display In: Electronics, Dec. 15, 1982, S. 128-130.

DE-Z: Funk-Technik, 40, 1985, H.5, S.209.

*Primary Examiner*—Donald J. Yusko
*Assistant Examiner*—Ashok Patel
*Attorney, Agent, or Firm*—Ware, Fressola Van Der Sluys & Adolphson

[57] ABSTRACT

A flat CRT display tube has a faceplace (11) with a fluorescent pixel screen (33) on its interior face. An area cathode assembly has an orthogonal array of segment electrodes (27) with overlying heater wires (25) spaced above them. A control assembly (38) arrayed between the cathode assembly and the screen includes orthogonal arrays of row electrodes (20) and column electrodes (21) with an overlying anode (19). A frame (18) supports the cathode assembly and the control assembly, and is itself supported by the tube's envelope, preferably by its faceplate (11).

9 Claims, 5 Drawing Sheets

FLAT PANEL FLUORESCENT SCREEN DISPLAY TUBE

CROSS REFERENCE TO RELATED APPLICATION

This application is a continuation of the present inventors' co-pending application Ser. No. 07/503,479 filed Apr. 2, 1990 now abandoned.

BACKGROUND OF THE INVENTION

1. Field of the Invention

The invention relates to a flat display in which a fluorescent screen is excited to luminescence by means of electrons from a cathode arrangement with cathode wires.

2. Description of the Prior Art

Flat displays usually feature a faceplate with a surrounding flange. This flange is not directly joined to the flange of a housing arrangement, but the edges of a control arrangement are placed between the two flanges, whereby the housing and the faceplate are joined and the control arrangement is retained in a single operation. The housing arrangement supports a cathode arrangement. When the display device is operated, electrons from the cathode arrangement pass through the control arrangement and impinge on the fluorescent screen on the faceplate. This can be provided with a laster in rows and columns, whereby all pixels in a row or at least a part of a row are simultaneously excited to luminescence. An example of a flat display of this design is described in U.S. Pat. No. 4,720,657.

The design mentioned above was also adopted by the applicant. However, the applicant realized that with this traditional design it is difficult to accurately align the faceplate, the control arrangement and the housing arrangement. Accordingly, the problem existed of specifying a flat display which could be easily manufactured.

SUMMARY OF THE INVENTION

The flat display according to the invention has a control arrangement which is retained by a frame which is mounted in the interior chamber of the display device. Either the faceplate or the housing arrangement can function as fixing parts. Due to the fact that a separate frame is used for retaining the control arrangement, it is no longer necessary to stabilize it by means of the flange of the faceplate and/or the flange of the housing arrangement. Instead, the control arrangement exhibits an inherent stability and it can be aligned with the housing arrangement or the faceplate with great accuracy. When the faceplate and the housing arrangement are joined, it is then only necessary to align these two parts carefully.

As regards ease of manufacture, it is especially advantageous to manufacture a single assembly with a reflector as a supporting component which supports not only the said frame and the control arrangement but also the cathode arrangement. This complete assembly can be manufactured separately with great accuracy. It then only needs to be mounted on the faceplate or the housing arrangement by means of a retaining bracket, whereby it must be ensured that the control arrangement is exactly aligned with the fluorescent screen. This alignment can be performed with great accuracy especially when the assembly is mounted on the faceplate.

However, contacting is then problematic. An advantageous arrangement consists in dividing the housing arrangement in two when the assembly is mounted on the faceplate. This is done using a cover which is mounted only when terminals on the assembly are connected to feed-throughs in the housing side.

Great positioning accuracy with easy contacting is obtained when the control arrangement and its frame are mounted on the faceplate but at least a part of the cathode arrangement, preferably the entire cathode arrangement, is attached to the housing arrangement. The control arrangement can be contacted with relatively few connections, e.g. about 20 connections, while the cathode arrangement requires many connections, e.g. about 200. The connections for the cathode arrangement can then be connected with feed-throughs in the housing arrangement before the faceplate and the housing arrangement are assembled. In addition, the housing arrangement supports a contact pad which contacts contact springs for the control arrangement when assembled with the faceplate. The control arrangement can be very accurately positioned in relation to the fluorescent screen on the faceplate. On the other hand, very great accuracy is generally not important when positioning the housing arrangement with the cathode arrangement. However, this depends in certain cases on the design of the cathode arrangement.

In any case, the control arrangement is composed of metal electrodes and the faceplate is composed of glass. The said reflector can be of metal, but it is always assumed below that it is made of glass. If the metal of the control arrangement and the glass of the faceplate and the reflector have the same heat expansion coefficients, it is relatively easy to mount the control arrangement directly on the faceplate or the reflector. However, in the case of display devices with very high resolution, it is desirable to manufacture the control arrangement from a metal which has a heat expansion coefficient which is considerably lower than that of glass. This desire results from the fact that the control arrangement is subject to a temperature rise during operation which is considerably greater than that of the faceplate. However, if the control arrangement expands more than the faceplate, the electron beams which pass through the control arrangement undergo a deflection in relation to the fluorescent strips or fluorescent pixels on the faceplate. If a metal with a low heat expansion coefficient is now used for the control arrangement in order to limit the said deflection, problems arise especially as regards manufacture of the display device, for this involves various high-temperature processes. In order to avoid deformations of the control arrangement during these high-temperature processes, the control arrangement, if it is composed of a metal which has a heat expansion coefficient which is different to that of glass is preferably not mounted directly on the faceplate or reflector, but is attached to these by means of a spring arrangement. This is not a bimetal arrangement as in colour picture tubes, whose function is to displace the mask in relation to the fluorescent screen in the beam direction, but an arrangement with simple elastic springs whose function is to absorb the different expansions due to heat, such as those which occur during the manufacturing process.

However, it is advantageous to select, whenever possible, a metal for the control arrangement which has the same heat expansion coefficient as that of the glass used for the faceplate and the reflector. However, in order to prevent undue deflections of the type described, heat sinks are mounted on the frame of the control arrangement so that heat from the control arrangement is dissipated in the best possible way in order to reduce the temperature difference between the control arrangement and the faceplate. It is also advantageous to install a mask between the electron beams and the fluorescent strips in the edge zones, i.e. to ensure that electron impact spots are slightly deflected towards the inside in relation to the fluorescent strips when the tube is cold. However, this deflection should only be so great that an electron beam destined for a certain fluorescent strip or fluorescent pixel still does not impinge on the adjacent strip or pixel.

DETAILED DESCRIPTION OF THE PREFERRED EMBODIMENTS

Figure 1:
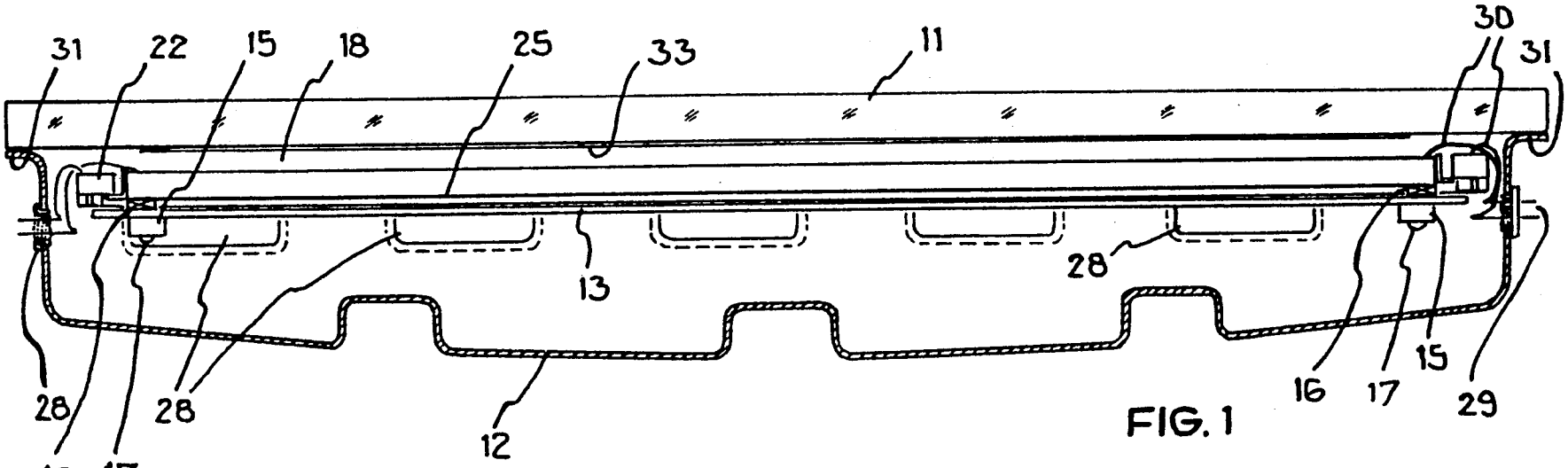
FIG. 1 is a cross-section of a flat display taken in the direction of the rows.
Figure 2:
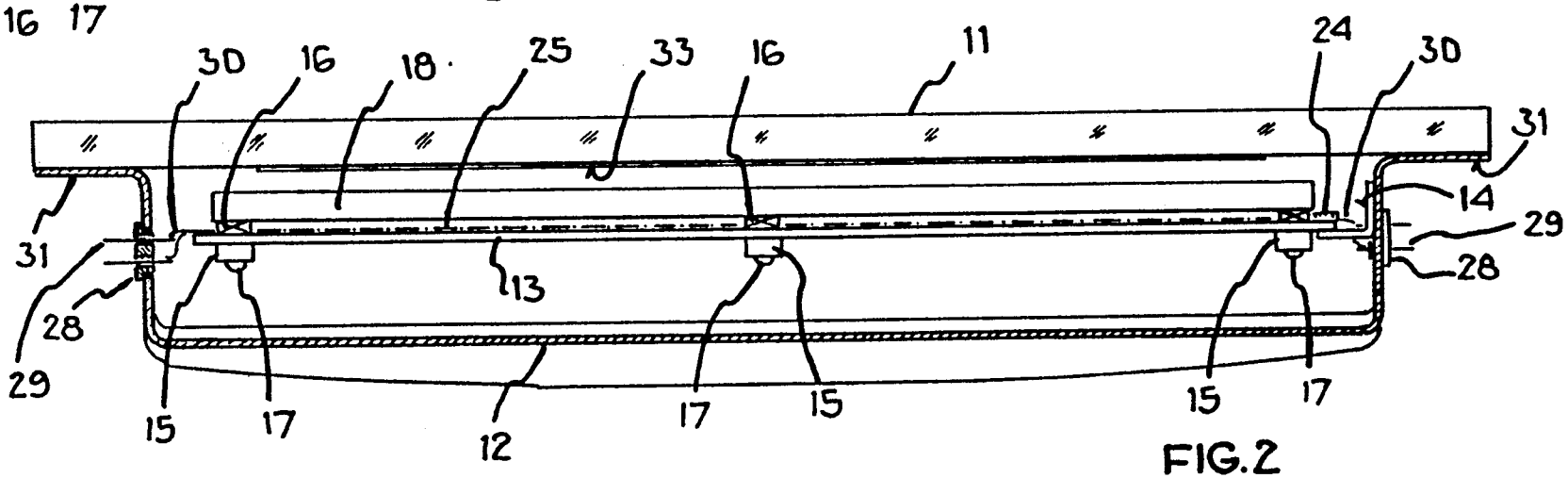
FIG. 2 is a cross-section taken in the column direction of the flat display according to FIG. 1.
Figure 3:
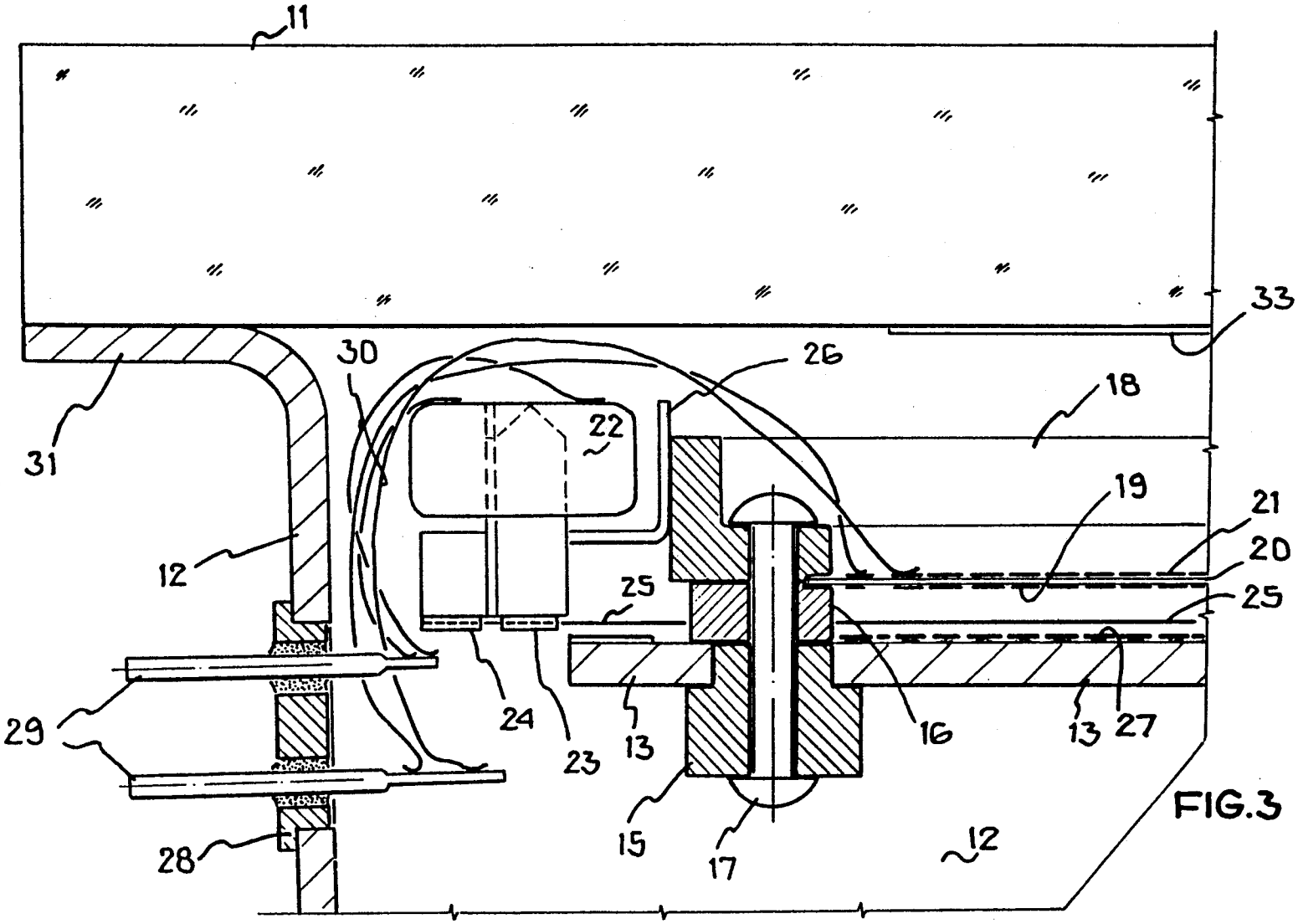
FIG. 3 is a magnified partial view of the area which is highlighted by the circle of dashed lines in FIG. 1 and which clearly shows how a cathode arrangement and a control arrangement are joined to form an assembly by means of a reflector.

The flat display according to the FIGS. 1–3 has a glass faceplate 11 with a housing 12 attached on its rear with which it forms a closed chamber which is evacuated. There is a layer of fluorescent pixels 33 on the inside of the faceplate 11, the single fluorescent pixels are not represented. The fluorescent pixels are preferably surrounded by a black matrix. The arrangement may also consist of fluorescent strips between which black matrix strips lie.

The electrodes required for operating the device are accommodated in a single assembly. This consists of a reflector 13 with a cathode arrangement and a control arrangement. The reflector 13 is joined to the housing 12 by means of a retaining bracket 14. The reflector retains a frame 18 via insulating centering pieces 15 and spacers 16 by means of rivets 17. A forward-acting anode 19, a line electrode arrangement 20, and a column selector electrode arrangement 21 are attached to this frame. A process by which metal electrodes of this kind can be interconnected is described in U.S. Pat. No. 4,745,332. The insulated, interconnected electrodes are joined to the frame 18 in their edge zone by means of a frit seam.

However, the frame 18 supports not only the control arrangement, but also a retaining rail 22 along each of its two high sides for the fixed contacts 23 and for contact springs 24. A heating wire 25 runs between a contact 23 on one side and a contact spring 24 on the other side. The retaining rails 22 (only one is drawn in FIG.3) are joined to the frame 18 by means of the frame bracket 26.

The heating wires 25 form a part of the cathode arrangement of the display device. A further part is formed by the segment electrodes 27 which are arranged on the reflector 13 and which run in the column direction. They are for brightness control. The segment electrodes 27, the heating wires 25 and the forward-acting anode 19 form a triode arrangement. Strictly speaking, the forward-acting anode 19 does not therefore belong to the control arrangement but to the cathode arrangement. However, in this application it is described as belonging to the control arrangement because it is structurally united with the actual control components, i.e. the row electrode arrangement 20 and the column electrode arrangement 21.

In the side walls of the housing 12, multi-pin electrical feed-throughs 28 are provided in a vacuum-tight arrangement. Their function is to feed the electrical connections of the single electrodes externally. The connections between the feed-through pins 29 and the electrodes are performed by the connection wires 30, a few of which are shown in FIGS. 1–3.

If the aforementioned assembly is attached to the housing 12 by the retaining bracket 14 and all the contacts have been made, the faceplate 11 is placed on the flange 31 of the housing 12. The parts are soldered together along the points of contact. Since no temperature process occurs following this, a resoftening glass solder can be used for soldering. An example of a suitable glass solder is the type 4210 made by Schott, if soft iron preferably coated with a protective nickel layer is used as the material for the housing. Sheet iron of this sort is obtainable from Hille and Müller under the name of Hilumin. Soldering instead of fritting has the advantage that, in case of a fault, the faceplate 11 and its fluorescent coating 33 or a rework of unsatisfactory produced contacts can be simply recovered. If it becomes apparent that an alignment error occurred in soldering between the housing and the faceplate, the glass solder can be softened to improve the alignment. Care must be taken that the electrode pattern of the control electrode arrangement is exactly aligned with the pattern of the fluorescent pixels 33.

Figure 4:
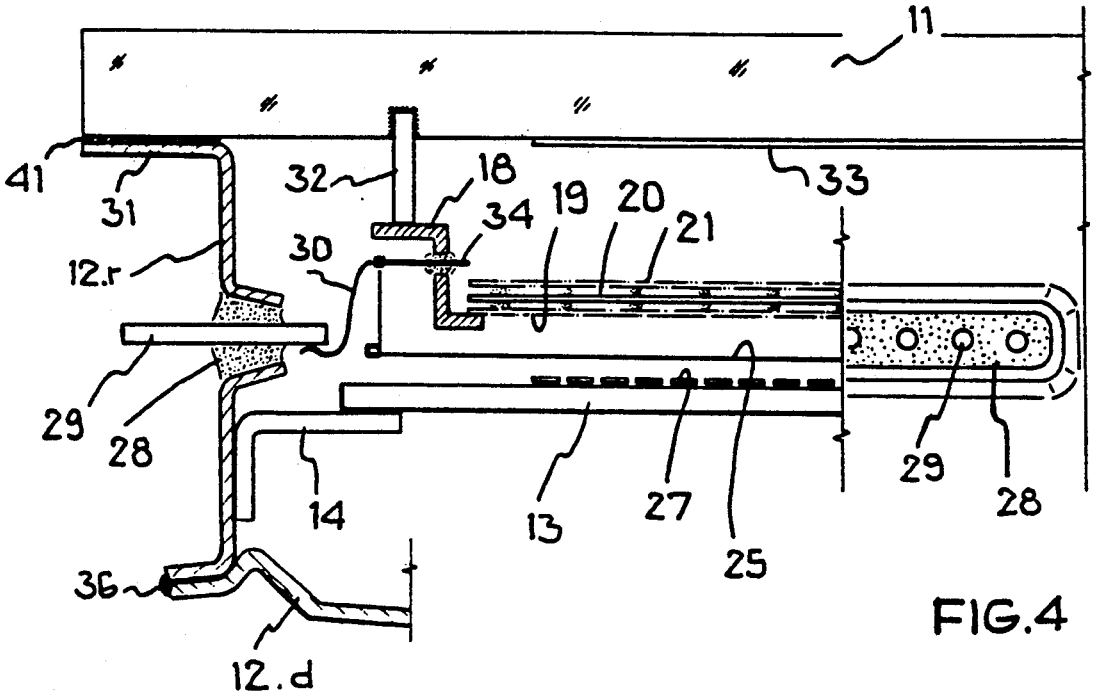
FIG. 4 is a schematic partial cross-section of a flat display in which the control arrangement and a part of the cathode arrangement are attached to the faceplate and the remaining part of the cathode arrangement is attached to the housing.
Figure 5A:
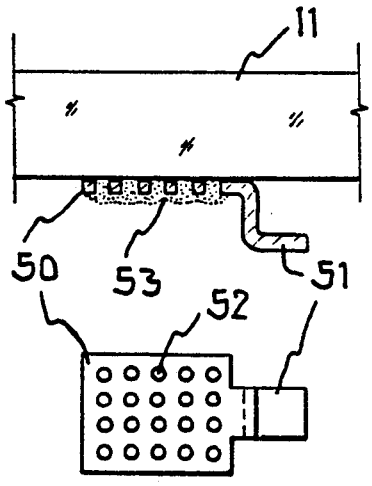
FIG. 5*a*–5*e* are schematic views for illustrating different methods of attaching a control arrangement on the faceplate.
Figure 5B:
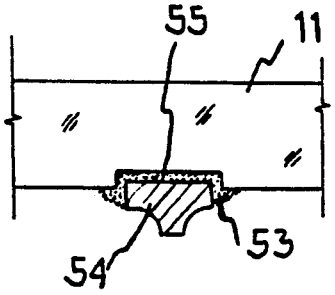
Figure 5C:
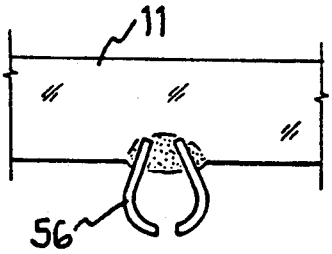
Figure 5D:
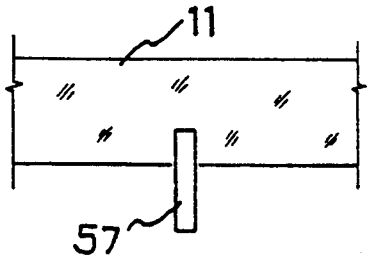
Figure 5E:
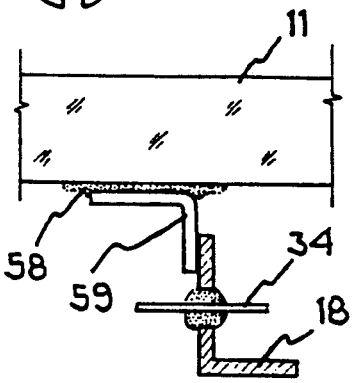

The aforementioned arrangement can be achieved with especially great accuracy if the frame 18 is directly attached to the faceplate 11, as depicted in FIG. 4. In this version, the housing is composed of two parts, with a housing side part 12.*r* and a housing cover 12.*d*. The housing and faceplate 11 are again joined along the housing flange 31.

Retaining pins 32 for joining the frame 18 to the faceplate 11 are fitted in the latter. As soon as the control plate arrangement is correctly aligned in relation to the pattern of fluorescent pixels 33, the frame 18 and the retaining pins 32 are joined by means of spot welds. The control arrangement again consists of a forward-acting anode 19, a row electrode arrangement 20 and a column electrode arrangement 21 which are joined by means of the frit bead 34.

Heater retaining pins 34, which elastically retain a majority of heating wires, are inserted in the frame 18. There are feed-through pins 29 for contacting these heating wires. They are attached insulated in the housing wall **12.*r* by means of a frit connection 35. A connecting wire 30 leads from each feed-through pin 29 to a heater retaining pin 34. In the section depicted in FIG. 4, only one of these wires is shown. Further wires lead from feed-through pins 29 in feed-throughs 28 to the electrodes of the control electrode arrangement. In FIG. 4, only a single feed-through 28 is drawn with dashes. Feed-throughs of this kind are situated in the edges of the housing wall 12**.r which are parallel to the paper plane.

However, the housing wall **12.*r* not only holds the feed-through pins 29, it also retains the reflector 13 and the segment electrodes 27. These segment electrodes are also connected to feed-through pins 29 by means of connecting wires 30, which are not shown. When all connections are established, the housing cover 12.*d* is mounted and welded vacuum-tight to the cover by means of a weld seam 36**, preferably argon-arc welding.

FIG. 5 shows several versions of retaining elements with which the frame 18 can be attached on the faceplate 11.

In the version according to FIG. **5*a*, each retaining element is Z-shaped and is attached to the faceplate by means of glass solder or a similar form of attachment. The part 50 lying on the faceplate has an aperture 52 through which the strength of the glass solder or frit connection 53 is considerably increased. The vertical part 51 of the element has the shape of tabs into which the frame 18** engages by means of catches and to which it is then attached by spot welds.

In the version according to FIG. **5*b*, each retaining element is a table-mountain-shaped iron part 54, which is fitted in a circular milled hole 55 by means of a frit connection 53**. The frame can be seated on the upper flat part.

In the version according to FIGS. **5*c* and *d*, iron hollow bodies 56 and pins 57 are inserted directly into the faceplate 11**.

In the version according to FIG. **5*e*, an angle bracket 59 is welded to a silver conductor coating 58, preferably by laser welding. The silver conductor coating 58 is baked into the faceplate 11 and preferably strengthened by electroplating. The frame 18 is directly mounted on the angle support 59**.

Figure 6:
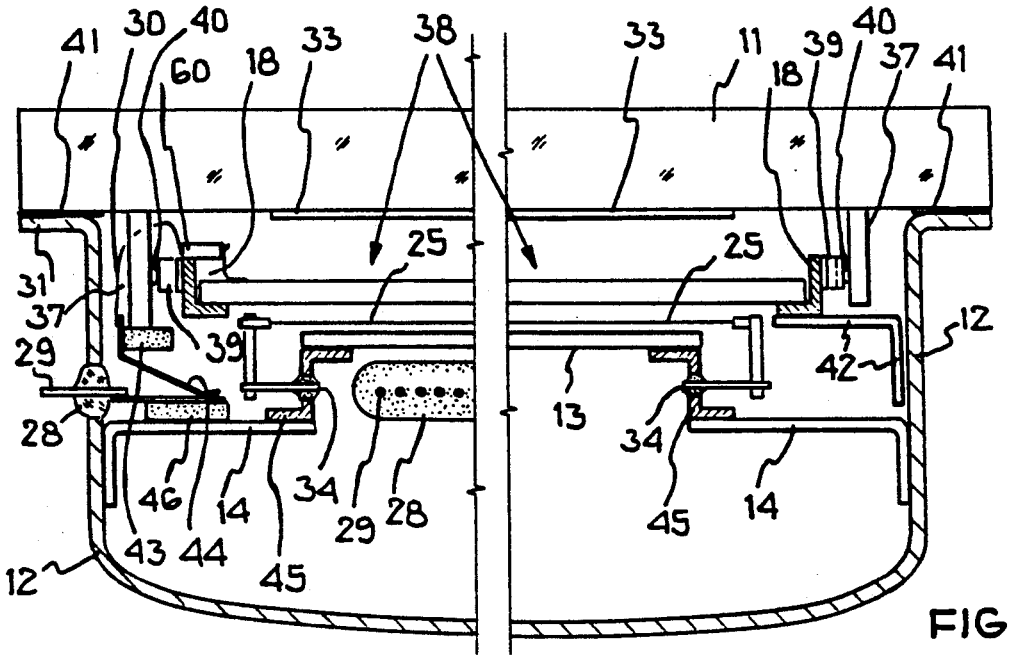
FIG. 6 is a schematic cross-section of a flat display, in which the control arrangement is joined to the faceplate by means of a spring arrangement and in which the cathode arrangment is retained by a housing.
Figure 7:
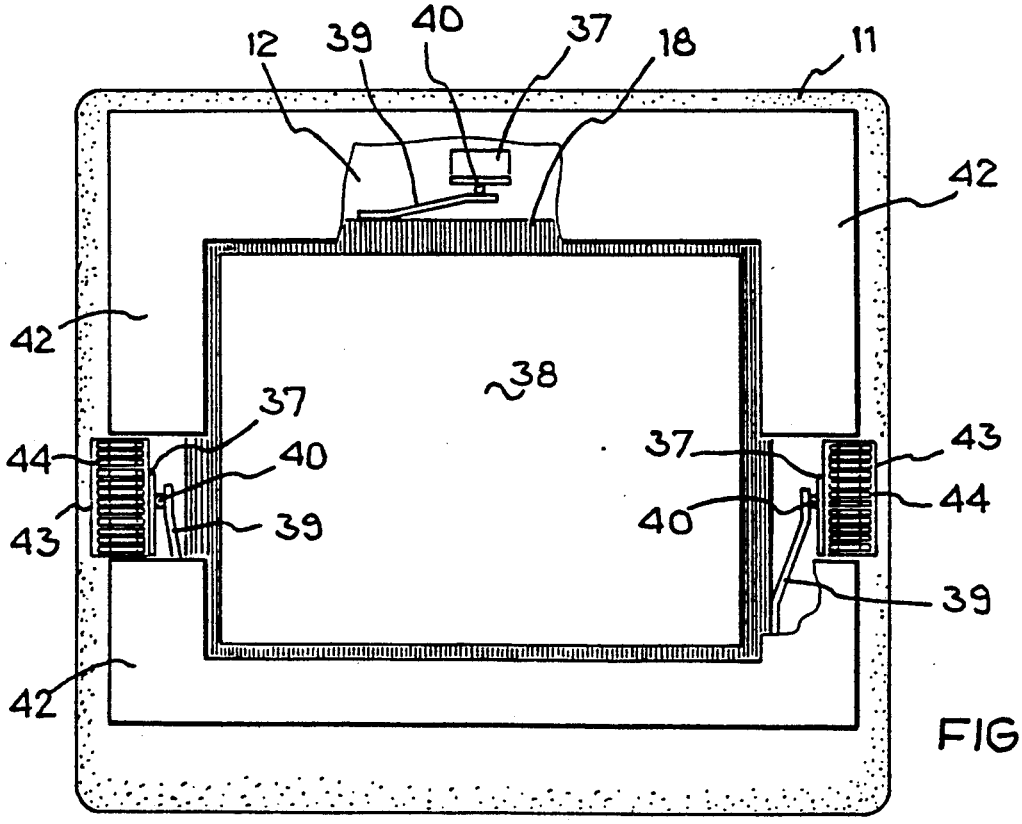
FIG. 7 is a rear view of the faceplate used in the display device according to FIG. 6, with the control arrangement joined to the faceplate by means of the spring arrangement, whose frame supports a heat sink.

The version according to FIGS. 6 and 7 contains two important differences compared to the versions previously described. Firstly, measures are taken to take account of different heat expansion properties between the faceplate and the control arrangement. Secondly, this is a construction which makes it possible to contact an assembly mounted on the faceplate only when the housing 12 and the faceplate 11 have been assembled.

In the version according to FIGS. 6 and 7, three retaining blocks 37 of glass are fritted to the faceplate 11. They hold the frame 18 to the control arrangement 38. The frame 18 is joined to the retaining blocks 37 by means of the frame springs 39 which have a feed-through near their free ends. The diameter of this feed-through is slightly smaller than the diameter of the centering balls 40 which are attached to the retaining blocks 37. The frame 18 is aligned in relation to the fluorescent coating 33 on the faceplate 11 in such a way that the pattern of the control arrangement 38 is aligned with the fluorescent pixel pattern. The frame springs 39 are then welded to the frame 18. The frame 18 and the control arrangement 38 are composed of a metal with low expansion coefficients, e.g. invar. If the faceplate 11 and the housing 12 are considerably heated during fritting to form a frit seam 41 between the faceplate 11 and the housing flange 31, the faceplate 11 expands considerably more than the control arrangement 38. This expansion difference is compensated by means of the frame springs 39.

Two further components are mounted on the frame 18, namely a heat sink 42 and a contact pad 43 with contact springs 44. A connecting wire 30 runs from each contact spring 44 to the control arrangement 38. In FIG. 6, only one of these wires is shown and in FIG. 7 there are no details concerning this. The contact pad 43 and the heat sink 42 can be easily identified in the top view according to FIG. 7.

The reflector 13 and its segment electrodes 27 (FIG.3) are attached to the housing 12 by means of a retaining bracket 14 and a reflector frame 45. The reflector frame 45 (FIG.6) holds heater retaining pins 34 and springs which hold taut the heating wires 25 acting as cathodes. The heating wires 25 and the segment electrodes which are not depicted are contacted from feed-through pins 29 which are seated in feed-throughs 28 in the housing. One of these feed-throughs 28 is indicated by dashes. These feed-throughs are seated in the housing in planes parallel to the plane of the drawing.

A contact mating strip 46 is seated on each retaining bracket 14. Only the contact mating strip in the left part of the housing is depicted in FIG. 6. The contact mating strip 46 has as many contact strips as there are contact springs 44 on the contact pad 43. The contacts are contacted by feed-through pins 29 which are fitted insulated in the housing 12.

If the frame 18 and the control electrode arrangement 38 have been attached in the described manner to the faceplate and the reflector 13 and heating wires 25 have been attached in the described manner to the housing 12 and contacted, the housing 12 and its flange 31 are mounted on the faceplate 11 with a frit layer between the two components. When mounting, the contact springs 44 are contacted so that all electrodes of the control arrangement 38 are connected to the feed-throughs 29 introduced from the outside. The housing 12 is aligned to the faceplate 11 in such a way that the heater wires 25 lie approximately parallel to row electrodes of the row electrode arrangement in the control arrangement 38. The housing 12 and the faceplate 11 are afterwards fritted together at high temperature.

Problems due to different expansions of the faceplate 11 and the control arrangement 38 occur not only in high-temperature manufacturing processes but also during operation of the display. This is because the control arrangement 38 is heated by the heater wires 25 to a temperature which is considerably higher than that of the faceplate 11, e.g. to about 80° C. compared with 30° C. for the faceplate. To limit the temperature difference as much as possible, there are heat sinks 42 on the frame 18. Due to the fact that heat from the frame 18 is dissipated by means of these heat sinks 42 and at the same time the faceplate 11 is additionally heated, the temperature difference between the control arrangement 38 and the faceplate 11 is smaller than if heat sinks were not present. If these heat sinks are used and if a mask is additionally incorporated, as explained below with the aid of FIG. 8, and if the dimension of the display is not too large, it is not necessary to use an expensive special metal with very low heat expansion for the control arrangement, but soft iron which is preferably provided with a protective layer, especially one consisting of nickel, can also be used for the electrodes of the control arrangement 38.

Figure 8A:
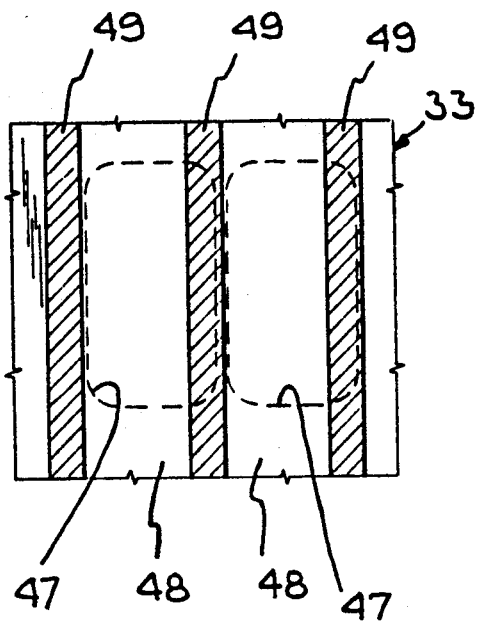
FIG. 8*a* and 8*b* are schematic representations to explain the function of the mask for limiting the movement of luminous spots in relation to fluorescent strips.
Figure 8B:
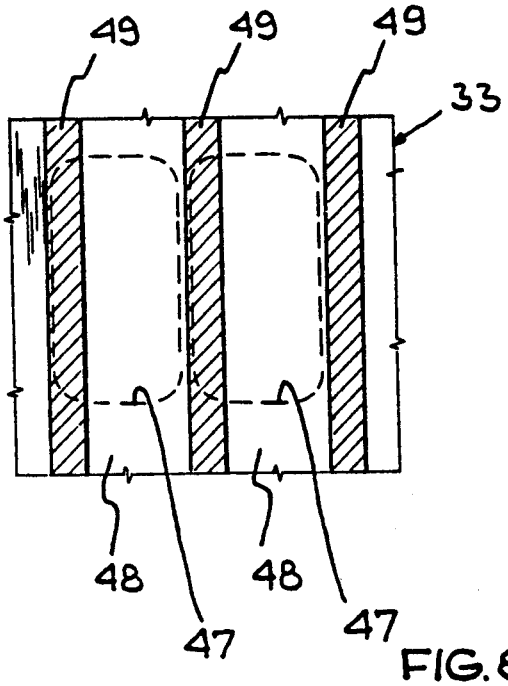

The following explanation concerns the aforementioned mask. As can be seen from FIG. 8, the mask is designed so that the width of electron beam impact spots 47 which are represented by dashed lines in FIG. 8 is larger than the width of the fluorescent strips 48. So that the adjacent fluorescent strip is not excited to luminosity by an electron beam intended for a specific fluorescent strip, a matrix strip 49 of black material is situated between every two adjacent fluorescent strips 48. FIG. 8*a* represents the effect of the mask as it is adjusted at the left edge of a flat display according to a one of the previous application examples for a picture tube which has still not reached operating temperature. The electron beam impact spots 47 lie very close to the right edges of the matrix strips 49, i.e. close to an adjacent fluorescent strip 48. If the control arrangement 38 now expands more than the faceplate 11 because of a higher operating temperature, the electron beam impact spots move to the left. With a picture tube at operating temperature, the situation according to FIG. 8*b* is reached, i.e. the impact spots 47 abut the left edges of the matrix strips 49. The mask initially adjusted according to FIG. 8*a* thus ensures that the impact spots 47 can move a certain distance across the fluorescent strips 48 without meeting an adjacent strip.

A mask of this kind, heat sinks and the right choice of material for the control arrangement 38 and the frame 18 together ensure that at all operating temperatures the electron beam impact spots only impinge on the fluorescent strips allocated to them.

Figure 9:
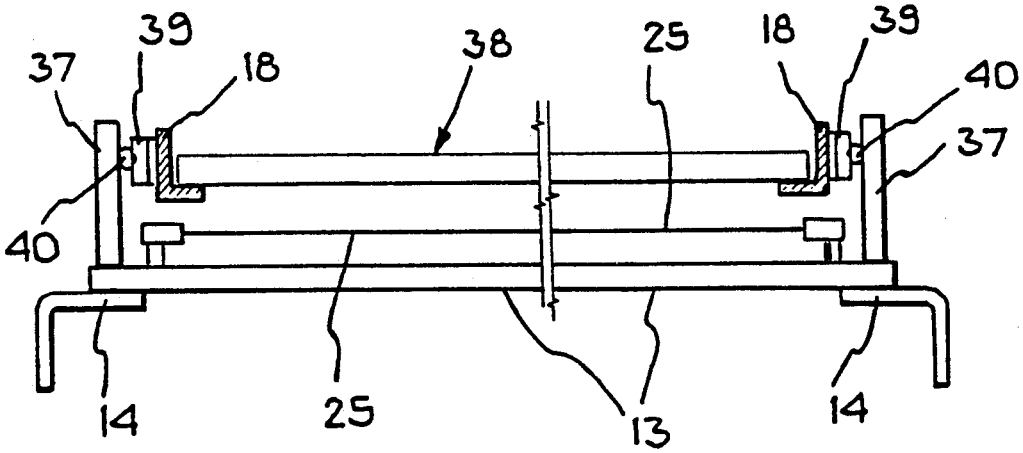
FIG. 9 is a schematic cross-section of an assembly similar to that used in the display device according to FIGS. 1–3, but with the difference that the control arrangement is joined to the reflector by means of a spring arrangement.

FIG. 9 depicts an application example that combines features of the application example according to FIGS. 1–3 and features according to the application example of the FIGS. 6 and 7. There is a single complete assembly, as in the case of the first application example, in which, however,, the frame 18 for the control arrangement 38 is not directly attached to retaining elements on the reflector 13. Instead, the connection is established across retaining blocks 37 with centering balls 40 and via frame springs 39. The rest of the construction is unchanged with respect to that according to FIGS. 1–3.

The construction according to FIG. 9 makes it possible to prepare an assembly in which the reflector 13 is made of glass, i.e. a material with relatively high expansion coefficients, whereas the control arrangement 38 and its frame 18 are made of a metal with low heat expansion coefficients. The reasons for this are explained above.

What is claimed is:

1. A flat panel fluorescent screen display tube having a plurality of substantially parallel rectangular planar components closely arrayed face-to-face within a substantially rectangular hollow envelope which has a rear housing (12) and a transparent front faceplate (11) sealingly joined to the rear housing, said planar components including:

a fluorescent raster screen of pixels (33) arrayed on the interior face of the faceplate;

a control assembly (38) incorporating an anode (19) and orthogonal pluralities of arrayed row electrodes (20) and arrayed column electrodes (21);

and an area cathode assembly incorporating a reflector (13) supporting an orthogonal arrayed plurality of segment electrodes (27) with an overlying arrayed plurality of heated wires (25) spaced therefrom, producing a large plurality of generally parallel electron streams traveling directly from the area cathode assembly through the control assembly perpendicularly toward the fluorescent screen with no major angular deflections, with no electron gun, no reversing lens and no diversion or deflection devices producing major electron beam deflections of between 90° and 180°, characterized in that the control assembly (38) is mounted spanning a substantially rectangular supporting frame (18) positioned inside said hollow envelope, with the area cathode assembly (13-27-25) and the control assembly (38) being arrayed sequentially between the rear housing(12) and the fluorescent raster screen pixels (33), and with the control assembly (38) being aligned with the fluorescent screen pixels.

2. The flat panel display tube defined in claim 1, wherein the area cathode assembly and the control assembly spanning the rectangular frame are both retained by the reflector, forming a single combined assembly which is mounted in the hollow interior of the envelope.

3. The flat panel display assembly defined in claim 2, wherein the single combined assembly is mounted inside and supported by a one-piece housing (12).

4. The flat panel display assembly defined in claim 2, wherein the single combined assembly is mounted on the faceplate (11), and the housing is made of two pieces, with a housing side (12.*r*) with feed-throughs (28) and a rear cover (12.*d*), which is joined vacuum-tight to the housing side after electrical connections have been established between the assembly and the feed-throughs.

5. The flat panel display assembly defined in claim 2, wherein the control assembly (38) and the reflector (13) are composed of materials which have substantially the same heat expansion coefficients.

6. The flat panel display assembly defined in claim 2, wherein the material of the control assembly (38) has a heat expansion coefficient which is lower than that of the material of the reflector, and wherein the control assembly and the reflector are connected by resilient spring means (39, 40,. 37) compensating for their differing thermal expansion coefficients.

7. The flat panel display assembly defined in claim 1, wherein the control assembly (38) is mounted on the faceplate (11), and at least one part of the area cathode assembly is mounted on the housing (12).

8. The flat panel display assembly defined in claim 7, including a contact arrangement which is mounted on the housing, (12) and which is electrically connected to the feed-through connections (29) in the housing, and which contacts connections on the control assembly (38) when the housing is joined to the faceplate (11).

9. The flat panel display assembly defined in claim 7, wherein the control assembly (38) is mounted on the faceplate (11) by spring means (39, 40, 37).

* * * * *

UNITED STATES PATENT AND TRADEMARK OFFICE

CERTIFICATE OF CORRECTION

PATENT NO. : 5,256,937

DATED : October 26,1993

INVENTOR(S) : Bubeck et al.

It is certified that error appears in the above-identified patent and that said Letters Patent is hereby corrected as shown below:

On the title page in Section [56], entitled References Cited, U.S. PATENT DOCUMENTS, line 5, "Lampert et al." should be --Lamport et al.--.

Signed and Sealed this

Thirty-first Day of May, 1994

Bruce Lehman

*Attest:*

BRUCE LEHMAN

*Attesting Officer*

*Commissioner of Patents and Trademarks*